US007845780B2

(12) United States Patent
Reinhardt

(10) Patent No.: US 7,845,780 B2
(45) Date of Patent: Dec. 7, 2010

(54) INK CARTRIDGE

(75) Inventor: Ulf Reinhardt, Wetter/Ruhr (DE)

(73) Assignee: Artech GmbH Design + Production in Plastic, Dortmund (DE)

( * ) Notice: Subject to any disclaimer, the term of this patent is extended or adjusted under 35 U.S.C. 154(b) by 823 days.

(21) Appl. No.: 11/802,416

(22) Filed: May 22, 2007

(65) Prior Publication Data

US 2007/0279463 A1 Dec. 6, 2007

(30) Foreign Application Priority Data

Jun. 2, 2006 (DE) ..... 10 2006 026 258

(51) Int. Cl.
*B41J 2/175* (2006.01)

(52) U.S. Cl. ..... 347/86

(58) Field of Classification Search ..... 347/84, 347/85, 86, 87
See application file for complete search history.

(56) References Cited

U.S. PATENT DOCUMENTS 5,040,002 A * 8/1991 Pollacek et al. ..... 347/87
5,807,085 A * 9/1998 Yajima ..... 417/505
5,875,615 A * 3/1999 Ito et al. ..... 53/474
7,195,345 B2 * 3/2007 Shinada et al. ..... 347/85
7,553,006 B2 * 6/2009 Busch et al. ..... 347/86

FOREIGN PATENT DOCUMENTS

EP 0 238 829 3/1991
EP 0 709 207 2/2002

* cited by examiner

*Primary Examiner*—Amh T. N. Vo
(74) *Attorney, Agent, or Firm*—Welsh Flaxman & Gitler LLC

(57) ABSTRACT

This invention relates to an ink cartridge which has at least one ink container which has an ink outlet with an ink outlet opening which extends from the inside to the outside, in the ink outlet opening a differential pressure valve is mounted which includes a valve seat and a valve body which can move relative to it, the valve seat has a continuous valve opening which has a peripheral sealing surface outside, a spring means is attached between the movable valve body and the stationary ink outlet, the valve body is pressed by the spring means with a predetermined closing force to form a seal from the outside against the sealing surface of the valve seat, and can be moved against the closing force to the outside from the sealing surface. In order to form an ink cartridge with a differential pressure valve which works more reliably, the invention proposes that the valve seat be made deformable so that the sealing surface can be moved relative to the ink outlet opening.

11 Claims, 3 Drawing Sheets

INK CARTRIDGE

BACKGROUND OF THE INVENTION

This invention relates to an ink cartridge which encompasses at least one ink container which has an ink outlet with an ink outlet opening which extends from the inside to the outside, in the ink outlet opening a differential pressure valve is mounted which comprises a valve seat and a valve body which can move relative to it, the valve seat has a continuous valve opening which has a peripheral sealing surface outside, a spring means is attached between the movable valve body and the stationary ink outlet, the valve body is pressed by the spring means with a predetermined closing force to form a seal from the outside against the sealing surface of the valve seat, and can be moved against the closing force to the outside from the sealing surface.

Ink cartridges of the indicated type are used as interchangeable ink tanks for ink supply of inkjet printing devices. Generally they have a housing which is made for attachment in the corresponding receiver of a printer. In the housing of the ink cartridge one or more ink containers which can be filled with different inks are made as the actual ink reservoirs. Each ink container has an ink outlet opening for detachable connection to the ink supply connection of the printer. In this way ink is supplied to the printer in operation. When the ink contained in the ink container has been used up, the empty ink cartridge can be easily taken out of the receiver and can be replaced by a full ink cartridge. The empty ink cartridges are either thrown away or refilled with ink for re-use.

Smaller inkjet printers of simple structure require that the ink at the ink outlet of the ink cartridge be at a given negative pressure level which corresponds to the negative pressure which is produced by the print head during operation at the ink supply connection of the printer. The negative pressure level must be kept within narrow limits: On the one hand, it must be ensured that the ink does not run out of the ink cartridge by itself due to the force of gravity and disrupt the operation of the print head, on the other hand the pressure level may not be so high that ink can no longer be sucked out by the print head.

In order to keep the ink ready at the ink outlet opening of the ink cartridge at a predefined negative pressure, placing a differential pressure valve in the ink outlet is known. It opens when the print head is working and is intaking the ink, by which a negative pressure is produced on the ink supply connection, and ink can flow to the print head.

Ink cartridges with differential pressure valves in the ink outlet are known in diverse versions, for example from EP 238 829 B1. It describes a valve with a cap-shaped valve body which spring-loaded seals against the sealing surface of the ink outlet opening from the outside and clears the passage opening when a predetermined negative pressure level on the outside of the differential pressure valve is not reached by the print head. The use of an elastic valve body does have the advantage of a simple structure. But the disadvantage is that production of an elastic valve body with the required precision of elastic properties in large numbers is relatively complex. Moreover the properties of elastic materials change with time, so that the valve becomes leaky or the pressure difference which is required for opening becomes too high or too low.

To some extent, the aforementioned problems can also be resolved by the valve body being pressed by a spring element against a valve seat. This concept is described for example in EP 709 207 B1. The version of the valve known from it has the major disadvantage that even slight misorientation of the valve body relative to the sealing surface leads to operating problems. But this is the normal case since the valve body can move in the ink outlet opening and for this reason necessarily has mechanical play. In this way the differential pressure valve in the closed state can be leaky, by which the negative pressure level at the ink outlet cannot be maintained, consequently ink emerges uncontrolled and malfunctions and damage on the printer can occur.

In view of the aforementioned problems in the existing art, it is an object of the invention to devise an ink cartridge with a differential pressure valve which works more reliably.

SUMMARY OF THE INVENTION

To achieve this object, the valve seat is made to be deformable so that the sealing surface can move relative to the ink outlet opening.

In the invention the sealing surface, in contrast to the existing art, is not fixed permanently in the ink outlet opening, but can move within the ink outlet. This is preferably achieved by the valve seat being made inherently flexible. Thus it is possible to keep the valve seat inside in the cross section of the ink outlet opening while the valve seat can be moved relative to it.

One advantage of the invention can be achieved by the valve seat being made to be deformable, for example as an elastic rubber molded part. It can be made inherently elastically flexible by simple shaping, for example as a tube segment.

It is furthermore advantageous that the sealing surface can tilt laterally. This can be accomplished for example by a type of tilt joint which is formed by a peripheral molding in a tubular segment of the valve seat. In this way possible tilting of the valve body in the ink outlet can be equalized. The valve body in the closed state always optimally seals against the sealing surface.

One advantageous embodiment of the invention calls for the sealing surface to be movable in the lengthwise direction of the ink outlet opening. This axial mobility can be achieved for example by a bellows-like levelling piece so that the sealing surface can move in the lengthwise direction of the ink outlet opening. In this connection it is advantageous that the valve seat first stretches to the outside when the printer is intaking ink, before the valve body is lifted off the sealing surface. In this way a negative pressure gradually builds up, suppressing unwanted valve wobbling. The differential pressure valve as claimed in the invention consequently has especially favorable response behavior. Moreover by pulling back the valve seat, afterrunning or dripping of ink is prevented when the printer is no longer intaking ink or the ink cartridge is being removed from the printer. This enhances handling and operating reliability.

Preferably the sealing surface is made conical. Spherical valve bodies can be sealed especially well in the inner cone which has been formed in this way. Moreover a peripheral sealing lip with the shape of a conical jacket can be likewise formed which achieves good sealing action on flat and also crowned-spherical mating surfaces even for low sealing forces.

The valve body can have a crowned sealing surface which is made on the front side of an essentially cylindrical body. Alternatively the sealing surface can be made flat, conical or in some other shape.

The valve seat is preferably made as an elastomer molding, for example from rubber or a thermoplastic elastomer. In this way mobility of the valve seat as claimed in the invention can be easily accomplished. Moreover the sealing action is reliable at a low sealing force.

Advantageously the valve seat has a connecting piece which enables simple connection to the ink outlet opening. The connecting piece can be formed for example by a tube section which is attached to a corresponding coupling part, for example is slipped onto a connecting sleeve which has been molded on the ink outlet opening.

The spring means can have a compression spring which is supported with one end against a fixed axial abutment in the ink outlet opening and with the other end against the valve body. Alternatively the spring means has a first permanent magnet which is mounted on the valve body, and a second permanent magnet which is attached securely in the ink outlet opening relative to the valve opening and which is opposite the first permanent magnet with the same pole so that the repulsion force between the first and second permanent magnets acts as a closing force on the valve body. The valve force with which the valve body is pressed against the sealing surface is consequently alternatively produced by a mechanical spring element or by magnetic repulsion. The repelling magnetic force can be implemented by first and second magnetic elements being attached to the movable valve body and to the abutment which is stationary relative to the sealing surface. The magnetic elements are opposite one another with the same magnetic poles, therefore north-north or south-south, by which a magnetic force acts which is pointed to the outside with respect to the connecting line of the two magnets.

Magnetic transmission of the closing force to the valve body takes place without contact. This makes it possible to produce the valve body with the first magnet and the housing with the second magnet individually at first and then to assemble them without a mechanical connection and thus especially easily into a differential pressure valve. Moreover other potential mechanical problems which could result from the use of conventional springs, for example friction, skewing, contaminants, etc. are eliminated.

Another advantage is that permanent magnets can be favorably produced in large numbers with narrow tolerances with respect to their magnetic and mechanical properties, for example by sintering processes. In this way the response behavior of the differential pressure valve as claimed in the invention can be dictated in a correspondingly accurate manner.

By using permanent magnets of hard magnetic materials with high remanence and permeability, magnets with small dimensions can be used which maintain their magnetization over a long time. Accordingly, the closing force remains constant and valve operation is also ensured over the long term.

Preferably the pole axes of the permanent magnets are coaxially aligned. In this way the first and second permanent magnets are axially opposite one another with the same magnet poles with respect to the connecting line, the radial orientation being without influence. This simplifies production and no unwanted torques act on the magnets.

It is advantageous for the permanent magnets to be made disk-shaped. For the magnetic properties it is advantageous for the magnets to be shaped as cylindrical disks with an axial direction of magnetization. They are easily located axially on top of one another on the valve body and the fixed abutment in the housing of the ink cartridge. Alternatively, the permanent magnets can be made cuboidal or annular—or also in different dimensions—in order to optimize the closing force or to adapt to the housing, for example to simplify installation.

One advantageous version of the invention calls for the valve body and/or the first permanent magnet attached to it to be guided on a guide in the direction of motion. A mechanical guide of the valve body can be formed for example by guide rods or rails and the corresponding openings in the valve body and in the housing. This results in that the valve body sits securely and exactly on the valve opening.

Another possibility for accurately positioning the valve body relative to the valve opening is for the first and second permanent magnet to form a self-centering magnet bearing. Such a magnet bearing can be formed for example by one of the permanent magnets being an axially magnetized ring which radially fixes the second magnet. In this way, contactless centering of the valve body relative to the valve opening can be accomplished.

The permanent magnets are more advantageously jacketed with plastic. In this way the magnets do not come into contact with the ink and are thus reliably protected against corrosion. Preferably the first magnet is injected into the valve body which is made as a plastic injection molded part and the second magnet is injected into the likewise plastic housing of the ink cartridge.

The ink cartridge can have one or more ink containers. The ink containers can be made as chambers within the housing or as a separate bag or the like which are inserted into the housing. Each individual one of these ink containers can be provided with a differential pressure valve as claimed in the invention.

BRIEF DESCRIPTION OF THE DRAWINGS

The invention is detailed below using drawings.

DETAILED DESCRIPTION OF THE DRAWINGS

Figure 1:
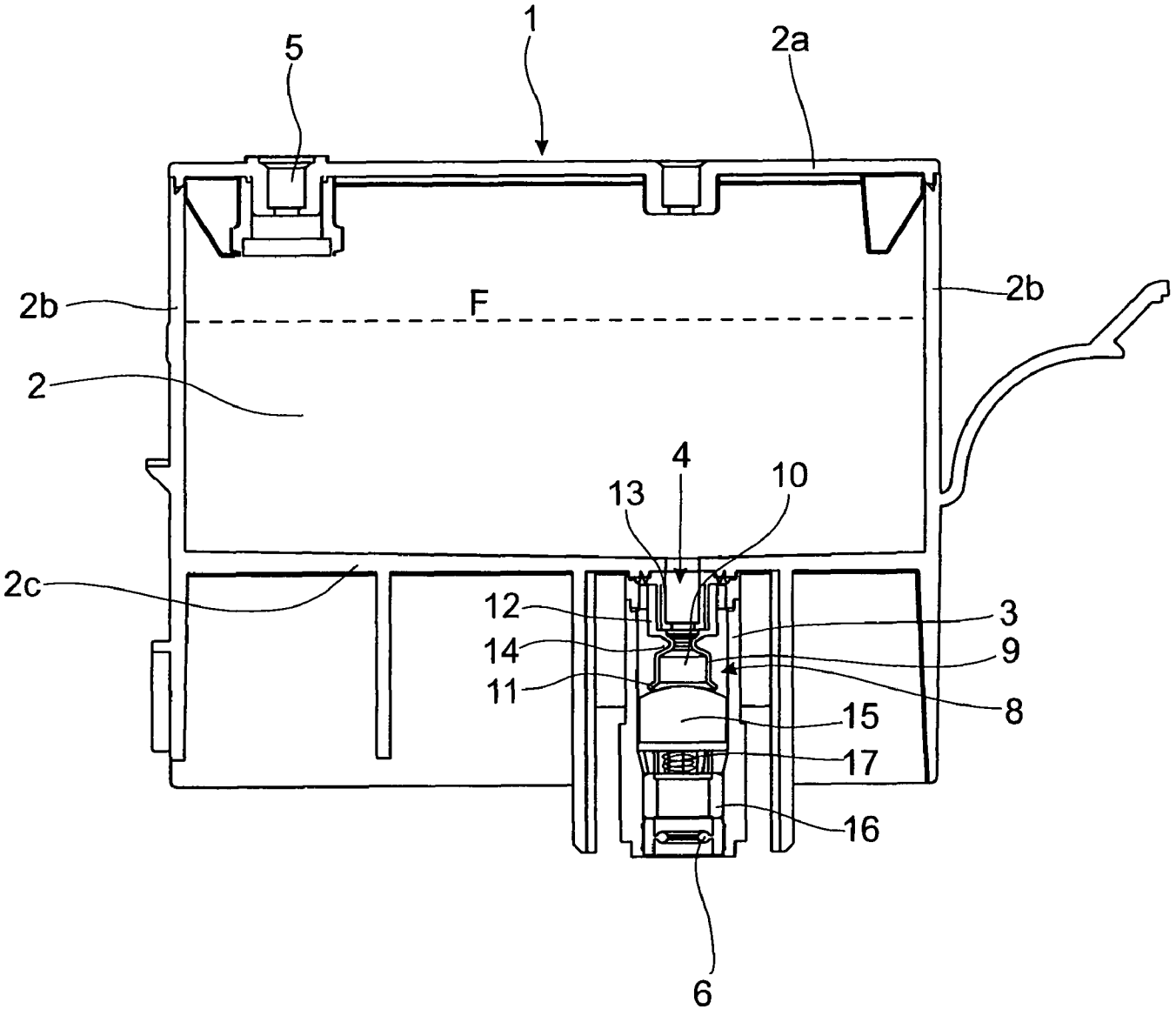
FIG. 1 shows a sectional view of an ink cartridge as claimed in the invention.

FIG. 1 schematically shows in a section an ink cartridge which is provided as a whole with reference number 1.

The ink cartridge 1 has an essentially box-shaped ink tank 2 which has a cover 2*a*, side walls 2*b* and a bottom 2*c*. Through the bottom 2*c* and a tubular ink outlet 3 which is attached thereto on the outside an ink outlet opening 4 extends from the inside to the outside.

The ink cartridge 1 is filled with free flowing ink up to the fill level F.

In the cover 2*a* there is a ventilation opening 5 which connects the ink-filled interior of the ink tank 2 to the vicinity and provides for the ambient air to flow after into the ink tank 2 when ink is removed through the ink outlet 3.

In the output of the ink outlet 3, a sealing element 6 is inserted through which a hollow ink removal needle for ink supply of an inkjet printer which is not individually shown can be connected to the ink outlet 3 for removing ink. The sealing element 6 can be for example an elastic gasket or a pierceable septum.

Figure 2:
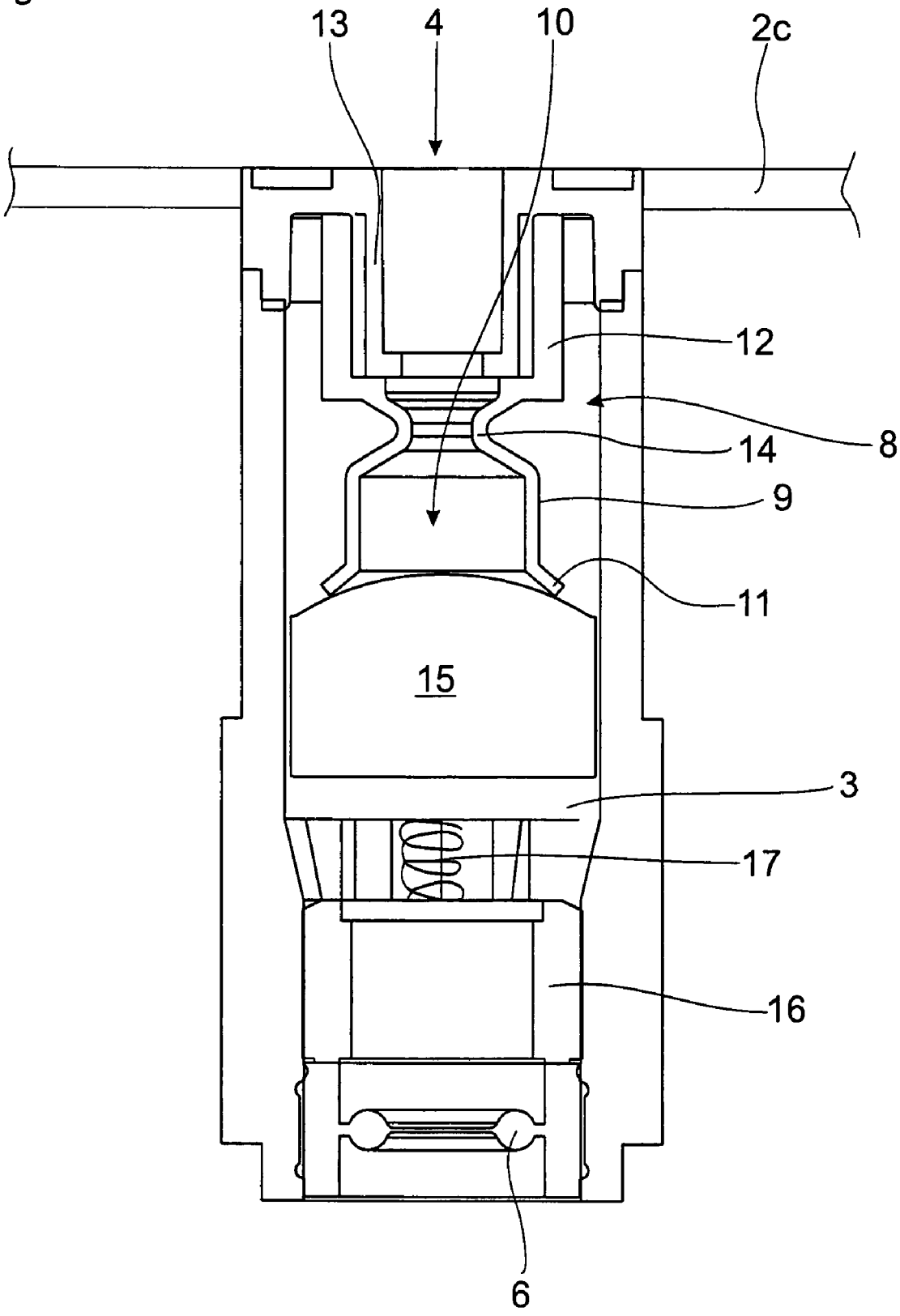
FIG. 2 shows a detailed view of the valve of the ink cartridge as shown in FIG. 1.

In the ink outlet opening 4 of the ink outlet 3 there is a differential pressure valve 8. This valve 8 is shown enlarged in FIG. 2 for better explanation.

Inside, therefore on the input side which is at the top in the drawings, the differential pressure valve 8 has a valve seat 9 with a continuous valve opening 10. Outside, i.e. down in the drawings, the valve seat 9 has a conical sealing surface 11 which runs around the valve opening and which widens to the outside. On the inner end of the valve seat 9 a tubular connecting piece 12 is made which is slipped onto an outlet sleeve 13 molded on the ink outlet opening 4. Between the sealing surface 11 and the connecting piece 12 the valve seat 9 is made with a peripheral molding 14, i.e. a bellows-like bead.

Figure 3:
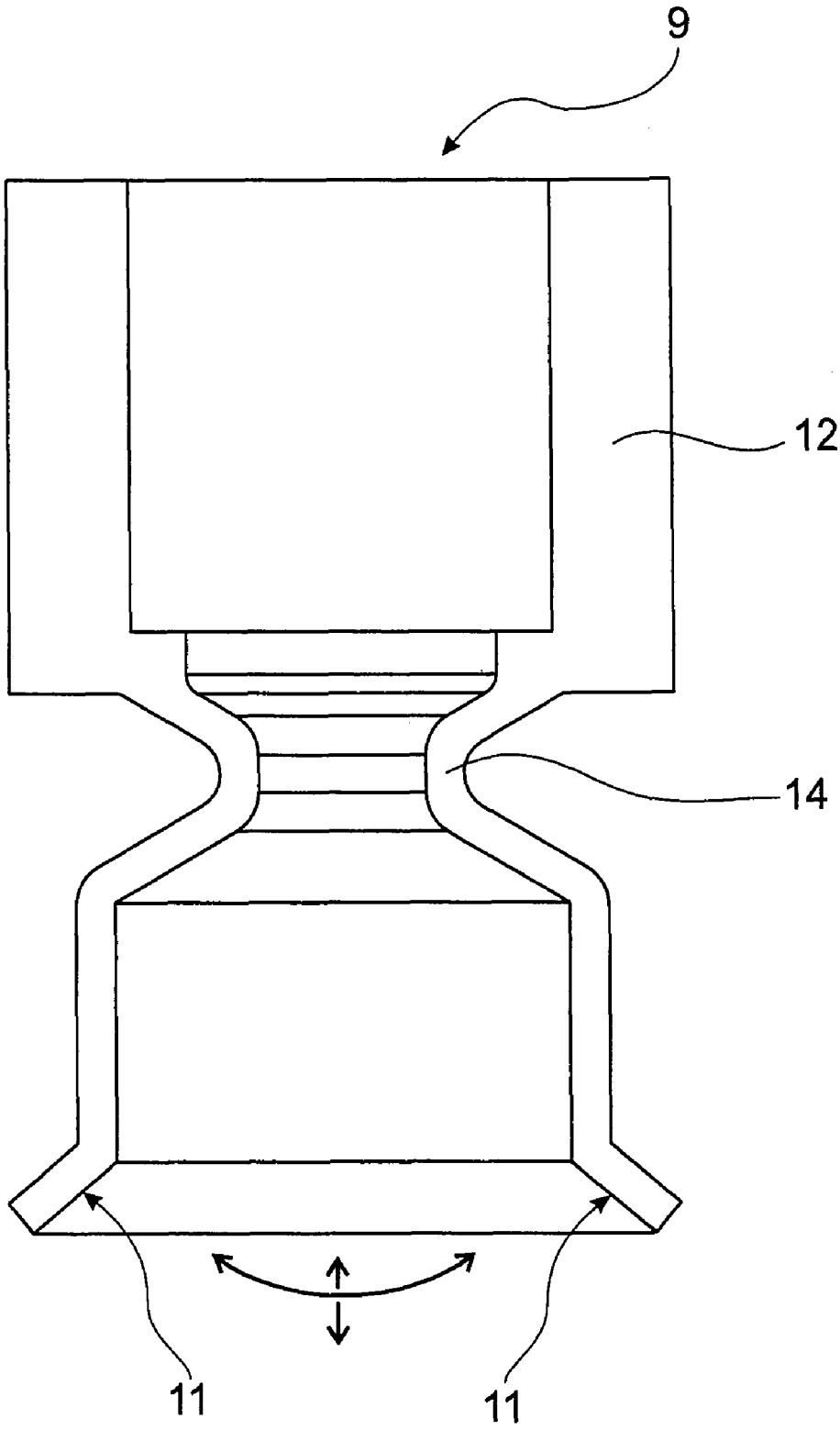
FIG. 3 shows the valve seat of the valve according to FIG. 2.

The valve seat 9 is shown enlarged in FIG. 3 for illustration of the details. It is likewise clearly recognizable in it how the sealing surface 11 is shaped on the valve seat 9 which runs out in the shape of a conical jacket so that a peripheral, resilient sealing lip is formed. The bent double arrow indicates how the sealing surface 11 can be laterally tilted around an articulation point located within the molding 14; the double arrow pointed up and down indicates axial mobility.

A valve body 15 which is supported to move lengthwise in the ink outlet 3, is pressed from the outside against the conical sealing surface 11 of the valve seat 9 to form a seal; this is indicated by the arrow. The closing force acting on the valve body 15 is produced by a spring means which is supported on a fixed abutment 16 in the ink outlet 3. The spring means can be implemented by a compression spring 17 which is shown schematically here being inserted between the valve body 15 and abutment 16, or alternatively by the valve body 15 and the abutment 16 being provided with mutually repelling magnets.

The valve body 15 has a crowned sealing side (top in the drawings) which is pressed against the sealing surface 11 by the spring means. In this way the valve opening 10 is closed, i.e. in the rest state no ink flows through the ink outlet opening 4 to the printer.

In operation, the printer intakes ink with a certain negative pressure through the ink removal needle 7 which is inserted sealed into the sealing element 6 in the output of the ink outlet 3. In this way, on the differential pressure valve 8 there is a differential pressure to the interior of the ink tank 2 which thus produces an opening force (pointed down in the drawing) on the valve body 11 which lifts it off the sealing surface 11 of the valve seat 9 against the closing force applied by the spring means, so that at this point ink can flow through the differential pressure valve 8. When there is no longer any negative pressure at the outlet, the pressure difference also disappears and the differential pressure valve 8 closes.

The active closing force is set by the spring means such that on the one hand the differential pressure valve 8 is closed tight when there is a liquid column which corresponds to the height of the ink tank 2 from the top when the ink cartridge 1 is full, and on the other hand the differential pressure valve 8 opens reliably when a printer is intaking ink at the output of the ink outlet 3.

One advantage of the invention arises from the sealing surface 11 being movable relative to the connecting piece 12 of the valve seat 9 which is attached securely in the ink outlet opening 4. This is achieved by the valve seat 9 being made deformable, for example as an elastic rubber molded part. In this connection the molding 14 forms a type of tilt joint around which the sealing surface 11 can tilt laterally, and moreover a bellows-like leveling piece so that the sealing surface can move in the lengthwise direction of the ink outlet opening 4. One advantage of this arrangement is that possible tilting of the valve body 15 in the ink outlet opening 4 is equalized and the valve body 15 in the closed state always optimally seals against the sealing surface 11. Moreover it is advantageous that the valve seat 9 first extends to the outside when the printer is intaking ink, before the valve body 9 is lifted off the sealing surface 11. In this way, first of all a negative pressure gradually builds up, suppressing unwanted valve wobbling. The differential pressure valve 8 as claimed in the invention consequently has especially favorable response behavior. Moreover by pulling back the valve seat 9, afterrunning or dripping of ink is prevented when the printer is no longer intaking ink or the ink cartridge 1 is being removed from the printer.

What is claimed is:

1. An ink cartridge having at least one ink container, which has an ink outlet with an ink outlet opening which extends from the inside to the outside, in the ink outlet opening a differential pressure valve is mounted which comprises a valve seat and a valve body which can move relative to the valve seat, the valve seat has a through valve opening which has a peripheral sealing surface, a spring means is attached between the movable valve body and the ink outlet, the valve body is pressed by the spring means with a predetermined closing force against the sealing surface of the valve seat from the outside to form a seal and can be moved against the closing force to the outside from the sealing surface, the valve seat being made deformable so that the sealing surface can be moved relative to the ink outlet opening, wherein the differential pressure valve opens when a pressure difference between an inside of the cartridge and an outside of the ink outlet opening exceeds a predefined pressure differential and wherein the spring means has a first permanent magnet which is mounted on the valve body, and a second permanent magnet which is attached securely in the ink outlet opening relative to the sealing surface and which is opposite the first permanent magnet with the same pole so that the repulsion force between the first and second permanent magnets acts as a closing force on the valve body.

2. The ink cartridge as claimed in claim 1, wherein the sealing surface can be moved in the lengthwise direction of the ink outlet opening.

3. The ink cartridge as claimed in claim 1, wherein the sealing surface can be tilted relative to the ink outlet opening.

4. The ink cartridge as claimed in claim 1, wherein the valve seat has an articulated section.

5. The ink cartridge as claimed in claim 1, wherein the valve seat has a tubular section with at least one peripheral molding.

6. The ink cartridge as claimed in claim 1, wherein the sealing surface is made conical.

7. The ink cartridge as claimed in claim 1, wherein the valve body is made crowned.

8. The ink cartridge as claimed in claim 1, wherein the valve seat is made as an elastomer molded part.

9. The ink cartridge as claimed in claim 1, wherein the valve seat has a connecting piece on the inside end.

10. The ink cartridge as claimed in claim 9, wherein the connecting piece of the valve seat is connected to the coupling part of the ink container.

11. The ink cartridge as claimed in claim 1, wherein the spring means has a compression spring which is supported with one end against a fixed axial abutment in the ink outlet opening and with the other end against the valve body.

* * * * *